US006952166B2

(12) United States Patent
Lee

(10) Patent No.: US 6,952,166 B2
(45) Date of Patent: Oct. 4, 2005

(54) BURGLAR ALARM SYSTEM HAVING REDUCED WIRING

(75) Inventor: John Kam Ho Lee, Wong Chuk Hang (HK)

(73) Assignee: Leeds Electronic Engineering Limited, Wong Chuk Hang (HK)

( * ) Notice: Subject to any disclaimer, the term of this patent is extended or adjusted under 35 U.S.C. 154(b) by 77 days.

(21) Appl. No.: 10/081,824

(22) Filed: Feb. 20, 2002

(65) Prior Publication Data

US 2003/0132843 A1 Jul. 17, 2003

(30) Foreign Application Priority Data

Jan. 16, 2002 (EP) ..... 02250277

(51) Int. Cl.[7] ..... G08B 13/14

(52) U.S. Cl. ..... 340/568.2; 340/568.1; 340/541; 340/652; 340/664

(58) Field of Search ..... 340/568.2, 568.3, 340/506, 548, 561, 650, 651, 541, 652, 638, 632, 286.01, 286.02, 286.05, 286, 540; 361/119

(56) References Cited

U.S. PATENT DOCUMENTS

| | | | | | |
|---|---|---|---|---|---|
| 4,032,916 | A | * | 6/1977 | Galvin et al. | 340/508 |
| 4,254,483 | A | * | 3/1981 | Vidovic | 367/94 |
| 4,321,592 | A | | 3/1982 | Crandall et al. | 340/541 |
| 4,554,411 | A | * | 11/1985 | Armstrong | 340/384.72 |
| 5,440,293 | A | * | 8/1995 | Tice | 340/568.1 |
| 5,517,175 | A | | 5/1996 | Brown et al. | 340/511 |
| 5,543,782 | A | * | 8/1996 | Rothbaum et al. | 340/568.2 |
| 6,094,143 | A | * | 7/2000 | Nakajima et al. | 340/630 |
| 6,182,497 | B1 | * | 2/2001 | Krajci | 340/632 |

FOREIGN PATENT DOCUMENTS

| | | |
|---|---|---|
| EP | 0026461 | 8/1981 |
| FR | 2600368 A | 12/1987 |
| GB | 2019072 | 8/1979 |
| GB | 2233803 A | 1/1991 |
| GB | 2297410 | 7/1996 |
| WO | WO 99/17262 | 4/1999 |

* cited by examiner

*Primary Examiner*—Davetta W. Goins
(74) *Attorney, Agent, or Firm*—Medlen & Carroll, LLP

(57) ABSTRACT

Normal hard-wired domestic burglar alarms have cables with six conductors extending between the alarm control panel and each event sensor (such as a PIR). Two of the conductors might provide current to a motion detector, two of the conductors might provide a circuit for a tamper switch, and two of the conductors might provide an indication of the motion detected by the motion detector. Wiring costs are reduced in the present invention by providing only two conductors which work to provide all of the functions of a six-conductor cable. To attach the two-conductor cable to a six-point terminal on the control panel, a special signal accessor and separator circuit is provided with six contacts to attach to the control panel terminals and two terminals for connecting to the conductor cable.

8 Claims, 4 Drawing Sheets

BURGLAR ALARM SYSTEM HAVING REDUCED WIRING

FIELD OF THE INVENTION

Normal hard-wired burglar alarms for domestic and commercial applications include a number of passive infra-red detectors (PIRs) situated around a space for detecting the heat that is radiated from a person moving around the area. Once that movement is detected, a PIR senses the movement and triggers an alarm via a control panel to which the PIR is hard wired. If the wire between the control panel and PIR is cut, a signal will also be generated and in some case, if the cover of the PIR is lifted, a tamper switch will trigger an alarm. Ordinarily, a cable having six internal conductors extends between the controller and each PIR, one pair of conductors providing electrical power, another pair of conductors providing a circuit with the PIR and the other pair of conductors providing a circuit to the tamper switch.

OBJECTS OF THE INVENTION

It is an object of the present invention to reduce the number of conductors between an alarm control panel and an event sensor such as a PIR.

It is a further object of the invention to provide a simple means of adapting an alarm system control panel designed to operate with cables each having many conductors extending to each individual event sensor to operate with cables having only a pair of conductors to each event sensor.

DISCLOSURE OF THE INVENTION

There is disclosed herein an alarm system comprising a cable between an alarm control panel and an event sensor, the cable comprising two conductors, and circuitry associated with said conductors for providing current to the event sensor and detecting changes in said current to indicate tampering at the sensor, severing of the cable and/or an event detected by the sensor.

Preferably, said circuitry is located in a housing from which the two-conductor cable extends and providing a short six-conductor cable for connection to an existing alarm control panel.

Preferably, shorting of the cable provides a maximum current state, an event detection by the sensor provides a medium current state, normal operating conditions provide a low current state, a severed cable or tampering with the event sensor provides a very low or no current state in said conductors, and said circuitry reacts to the current state of the conductors to provide appropriate conditions to each conductor of said six-conductor cable for recognition by said alarm control panel.

BRIEF DESCRIPTION OF THE DRAWINGS

A prior art alarm control panel and a cable extending from the panel to an event sensor is shown in FIGS. 1 and 1A respectively.

A preferred form of the present invention will now be describe by way of example with reference to FIGS. 2 to 6 of the accompanying drawings, wherein.

DESCRIPTION OF THE PRIOR ART

Figure 1A:
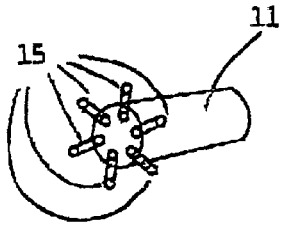
Figure 1:
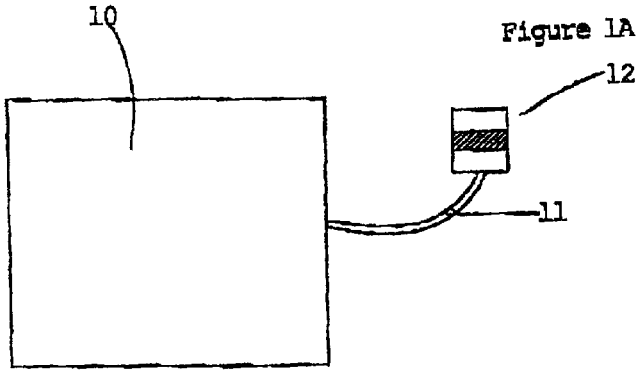
Figure 1 (Prior Art)

In FIG. 1 of the accompanying drawing there is schematically depicted a conventional alarm control panel 10 connected by a six-conductor cable 11 to a conventional passive intra-red detector. A segment of the six-conductor cable is shown in FIG. 1A to include six individual conductors 15. Each of these is connected to the passive infra-red detector 12 and corresponding terminals at the control panel 10. One pair of these conductors is for transmitting a signal that the passive infra-red detector has detected the body heat of a person moving in an area at which the PIR 12 is placed. That is, these two conductors provide a "zone alarm" signal to the control panel 10.

Another pair of the conductors 15 provides a signal to the control panel 10 that someone has cut the cable 11 or a tamper switch at the PIR has triggered. That is, these two conductors provide a "tamper" signal to the control panel 10.

The remaining pair of conductors provide a direct current supply to the PIR so as to power the PIR's circuitry.

Figure 2:
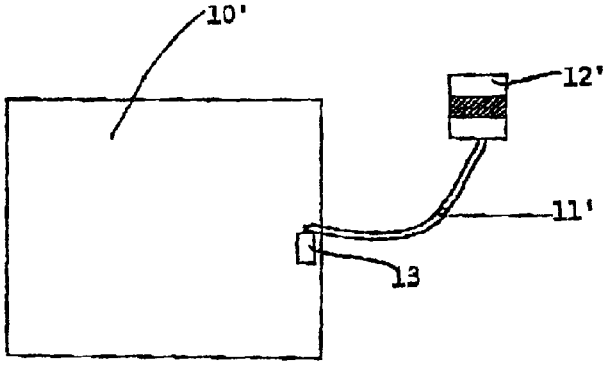
FIG. 2 is a schematic illustration of an alarm control panel modified for use with a two-conductor passive infra-red detector.
Figure 2A:
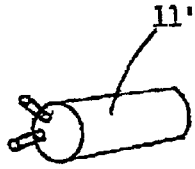
FIG. 2A is a schematic illustration of a segment of a two-conductor cable.

The present invention does away with the need for long lengths of six-conductor cable 11 and instead only requires equivalent lengths of two-conductor cable 11' as shown in FIG. 2A. To this end, the preferred embodiment of the invention provide a signal accessor and separator 13 and a specially modified passive infra-red detector 12'.

Figure 3:
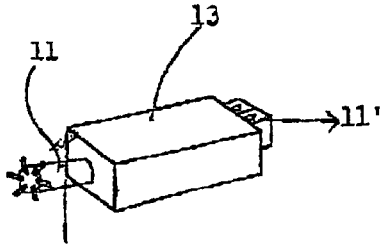
FIG. 3 is a schematic illustration of a signal accessor and separator.

As shown in FIG. 2, an alarm control panel 10' can include a modified circuit broad or an existing circuit broad with a modular addition of a signal accessor and separator unit 13 as shown in FIG. 3. The signal accessor and separator unit 13 includes a six-conductor cable input 11, internal circuitry 13C (FIG. 4) and a pair of terminals for attachment to a two-conductor cable 11'. A segment of such a cable is shown in FIG. 2A.

Figure 4:
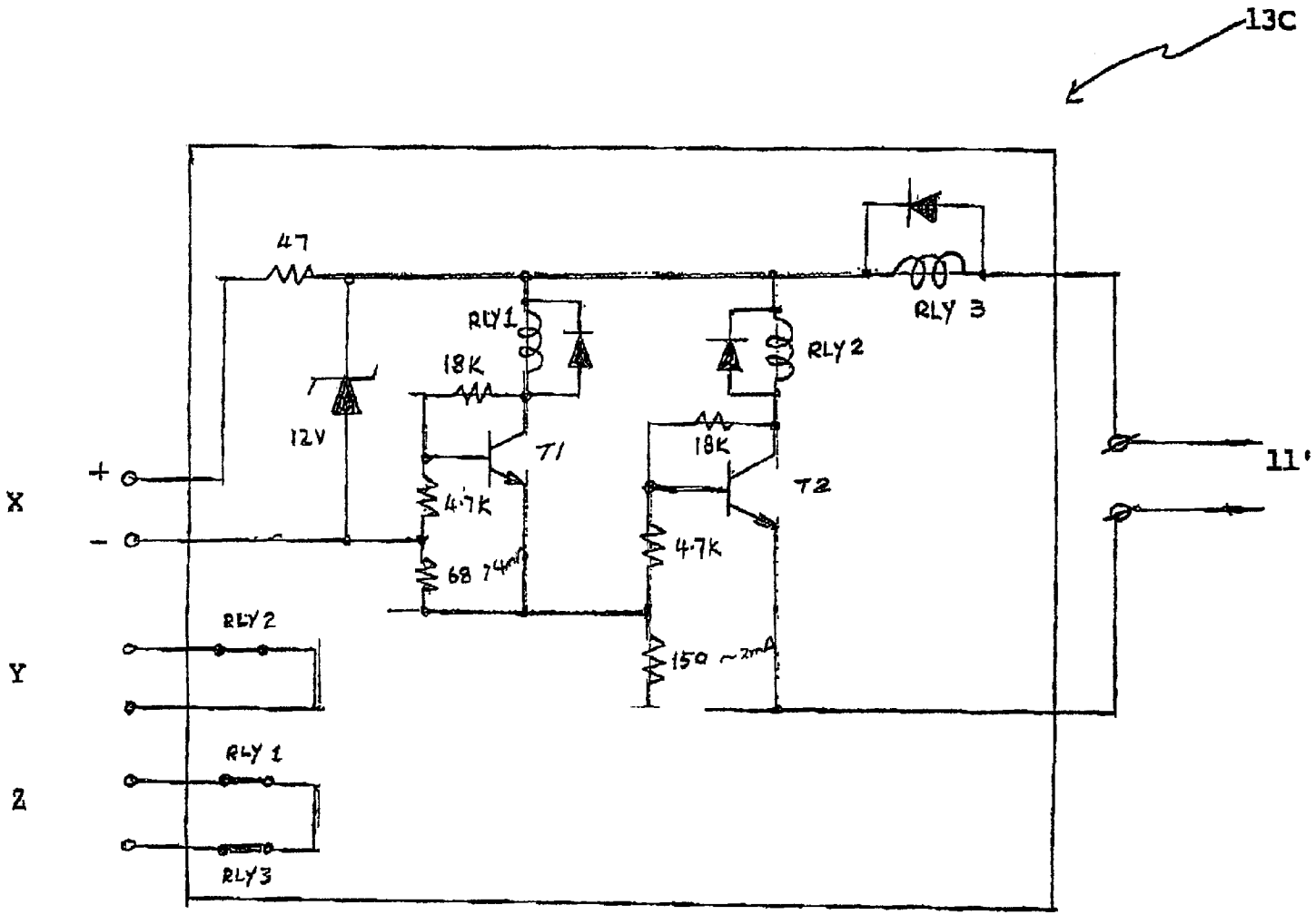
FIG. 4 is a schematic circuit diagram of the signal accessor and separator.

Typical circuitry for use in the signal accessor and separate unit 13 is shown at 13C in FIG. 4. Modified circuitry at the PIR itself is shown at 12'C in FIG. 5.

Figure 5:
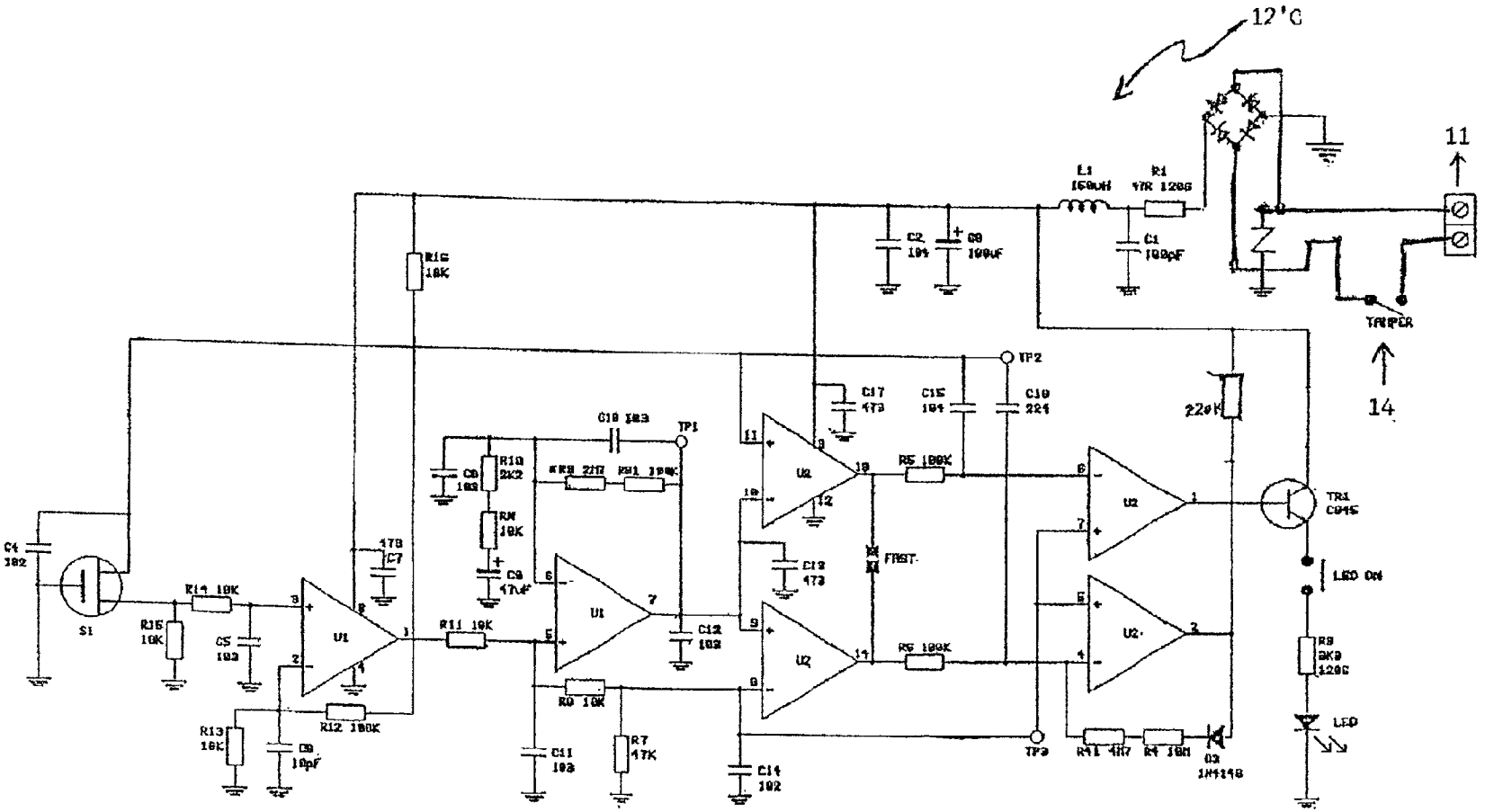
FIG. 5 is a schematic circuit diagram of a circuit used in a modified passive infra-red detector for use with a two-conductor cable.

Circuitry 13C is designed to monitor different levels of current consumption at circuitry 12'C located at the PIR unit 12'. The two circuits shown in FIGS. 4 and 5 are connected to each other via a two-conductor cable 11', as indicated.

In a normal operational stage, the current consumption at circuitry 12'C is at a low level L. Once a human body moves and the motion is detected by the PIR circuitry 12'C, the current consumption of circuitry 12'C increases to a medium level M. If the cable 11' is cut, or tamper switch 14 is opened, the current consumption level of circuit 12'C will be extremely low EL or zero. If a metallic object is used to cut cable 11', a momentary current through the cable will be higher H than the level provided when circuitry 13C detect's the movement of a human body in a space that at which it is directed.

Figure 6:
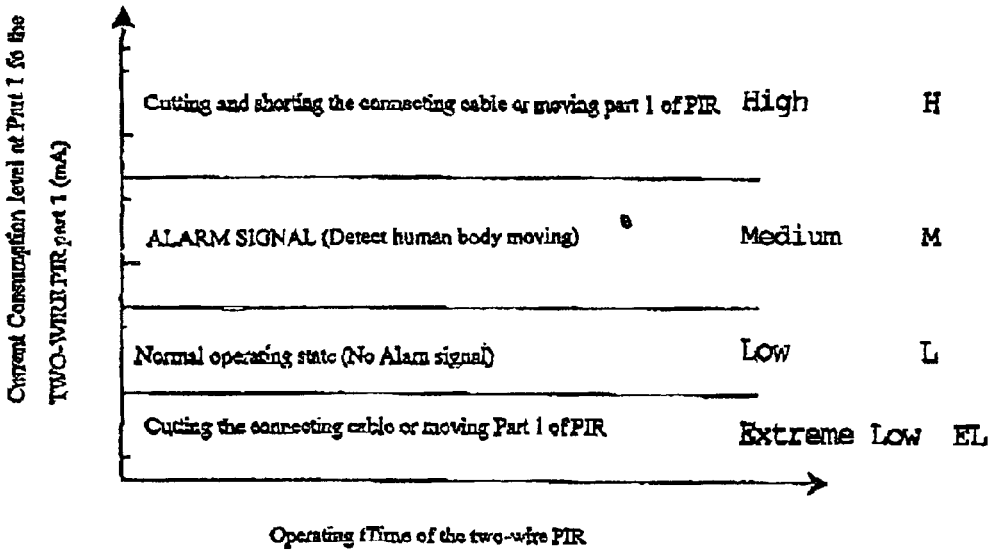
FIG. 6 is a graph showing current consumption and conditions identified thereby.

The signal accessor and separator circuit 13C converts the different signals upon detecting changes in current in cable 11' and converts them into signals appropriate for the six-conductor input of the alarm control panel. The current consumption level of the two-wire cable 11' is illustrated in FIG. 6. In FIG. 6, the thresholds between 'extreme low' and 'low' might typically be two 2 mA. The threshold between 'low' and 'medium' might be 4 mA and threshold between 'medium' and 'high' might be 10 mA say.

As shown in FIG. 4, circuitry 13C includes pairs of input terminals X, Y and Z. Terminals X are connected to a pair of conductor 15 in cable 11 (see FIG. 3) that provide continuous current for powering circuit 12'C at the PIR. Terminals Y are connected a pair of conductors 15 which would ordinarily have extended to the PIR to indicate a zone alarm signal and terminals Z are those which would have ordinarily be associated with tamper switch 14.

The present invention can provide a significant material and cost savings for the installation of alarm systems.

It should be appreciate that modifications and alternations obvious to those skilled in the art are not to be considered as beyond the scope of the present invention. For example, rather than providing a separate module 13, the signal accessor and control circuit can be incorporated integrally with the main circuitry of the control panel.

What is claimed is:

1. An alarm system comprising a cable and circuitry, wherein the cable extends between an alarm panel and an event sensor, the cable comprises two conductors, the event sensor comprises only two terminals, and the circuitry is associated with said conductors for providing current to the event sensor through said two terminals and detecting changes in said current through said two terminals, to indicate tampering at the sensor, severing of the cable and an event detected by the sensor.

2. The alarm system of claim 1 wherein said circuitry is located in a housing from which the two-conductor cable extends and providing a short six-conductor cable for connection to an existing alarm control panel.

3. The alarm system of claim 2 wherein shorting of the cable provides a maximum current state, an event detection by the sensor provides a medium current state, normal operating conditions provide a low current state, a severed cable or tampering with the event sensor provides a very low or no current state in said conductors, and said circuitry reacts to the current state of the conductors to provide appropriate conditions to each conductor of said six-conductor cable for recognition by said alarm control panel.

4. The alarm system of claim 1, wherein said event sensor is a passive infra-red detector.

5. An alarm system comprising a cable between an alarm panel and an event sensor, the cable comprising only two conductors, and circuitry associated with said conductors, for providing current to the event sensor and detecting changes in said current to indicate tampering at the sensor, severing of the cable and an event detected by the sensor.

6. The alarm system of claim 5 wherein said circuitry is located in a housing from which the two-conductor cable extends and providing a short six-conductor cable for connection to an existing alarm control panel.

7. The alarm system of claim 6 wherein shorting of the cable provides a maximum current state, an event detection by the sensor provides a medium current state, normal operating conditions provide a low current state, a severed cable or tampering with the event sensor provides a very low or no current state in said conductors, and said circuitry reacts to the current state of the conductors to provide appropriate conditions to each conductor of said six-conductor cable for recognition by said alarm control panel.

8. The alarm system of claim 5, wherein said event sensor is a passive infra-red detector.

* * * * *